US006070324A

United States Patent [19]

Kwiatek et al.

[11] Patent Number: 6,070,324

[45] Date of Patent: Jun. 6, 2000

[54] METHOD OF MANUFACTURING AN ALUMINUM BURNER CAP

[75] Inventors: David J. Kwiatek, LaGrange; Norman K. Peck, Bloomingdale; William R. McCarty, St. Charles, all of Ill.

[73] Assignee: Ranco Incorporated of Delaware, Wilmington, Del.

[21] Appl. No.: 09/036,144

[22] Filed: Mar. 6, 1998

[51] Int. Cl.[7] ..... B23P 15/00

[52] U.S. Cl. ..... 29/890.14; 29/890.02; 29/557

[58] Field of Search ..... 29/890.02, 890.14, 29/557; 72/267, 358, 377; 431/354

[56] References Cited

U.S. PATENT DOCUMENTS

| | | | |
|---|---|---|---|
| 2,046,682 | 7/1936 | Hardwick | 29/892.02 |
| 2,533,942 | 12/1950 | Jongedyk | 72/267 |
| 3,927,449 | 12/1975 | Gibble et al. | 72/267 |
| 4,731,015 | 3/1988 | Johnson | 29/890.02 |
| 5,042,283 | 8/1991 | Nishida | 72/267 |
| 5,266,026 | 11/1993 | Riehl | 29/590.02 |
| 5,328,357 | 7/1994 | Riehl | 29/890.02 |

*Primary Examiner*—Irene Cuda
*Attorney, Agent, or Firm*—Terrence Martin; Sean Detweiler; Jules Jay Morris

[57] ABSTRACT

A method of manufacturing a burner cap for a gas range includes the steps of providing an amount of non-porous aluminum and forming the aluminum into the shape of a burner cap such that the non-porous nature of the aluminum is maintained. In one embodiment, the non-porous aluminum is a slug at ambient temperature which is placed in a die and slowly forced into a die by an advancing a ram to form the burner cap. In another embodiment, the non-porous aluminum slug is machined to form the burner cap.

10 Claims, 4 Drawing Sheets

METHOD OF MANUFACTURING AN ALUMINUM BURNER CAP

FIELD OF THE INVENTION

This invention relates to home consumer appliances, and more particularly to home gas ranges having adjustable flame surface burners for cooking, each of the adjustable flame surface burners having a gas burner cap associated therewith.

BACKGROUND OF THE INVENTION

Gas ranges for home and commercial applications typically include gas burners 10 (see FIG. 1) located on the top cooking surface of the range. Gas is delivered to these top burners 10 as indicated by gas flow arrow 22 through the burner base 12 from a distribution manifold (not shown) which is controlled, typically, by twist-type control valves to allow the user to adjust the amount of gas flowing to the surface burner, thus allowing an adjustment of the flame setting resulting therefrom. Many of these gas burners 10 are circular in shape and contain an inner manifold defined between the burner base 12 and the inner surface burner cap 14 which distributes the gas evenly to each of a plurality of openings 24 which are defined by a vertical portion 23 on the burner base 12, and which are accommodated by a ridge 19 defined in the inner surface, and through which the gas flows to establish the cooking flames. Mixing of air and gas may be aided by the inclusion of a concave surface feature 20 included on the inner surface of the burner cap 14 which results in a more efficient burn mixture. Once the air/gas mixture has left the internal manifold through the plurality of openings 24 it is ignited to produce a plurality of cooking flames around the periphery of the gas burner 10 to allow for cooking on the surface of the range. For cosmetic appearance, a burner cover 16 may be included in the burner assembly 10.

As discussed briefly above, each of the individual gas burners 10 includes a gas burner cap 14 which forms the upper wall of the internal manifold and the upper surface of the gas burner itself (or may alternatively be covered by the burner cover 16 as desired). A typical gas burner cap 14 includes spacer/locator legs 18 which allow the cap to be properly positioned in relation to the burner base 12 of the individual burner assemblies 10. Because these gas burner caps 14 are subjected to high heat, at times approaching 900° F. to 1000° F., these caps have typically been manufactured from a cast iron material which is coated with a porcelain coating. The use of cast iron with a porcelain coating allows the burner cap to survive the high cap temperature which results from a low flame burner setting where the flames are allowed to exist just at the edge of the burner cap, and may slightly curl around the edge of the burner cap. While to use of porcelain coated cast iron allows the burner caps to survive these high temperature situations, the use of such a cap is cost prohibitive. Specifically, the use of cast iron is relatively expensive, compared to other materials which are available on the market. Additionally, the porcelain coating process of cast iron often results in bubbles or cracks in the coating on the cast iron burner cap. Since such cracks or bubbles may result in premature failure of the burner cap, not to mention having a poor appearance, such caps cannot be used and must be rejected in the quality review process, making it difficult to maintain acceptable yields from this process. Such problems result in unacceptably high scrap rates, thereby increasing the overall cost of manufacture of the burner caps as well as adding to the cost of the completed gas cooking range itself.

An alternative to the use of porcelain coated cast iron burner caps is to use burner caps which are constructed from forged brass. While the use of brass is advantageous due to its excellent heat transfer properties, the cost of using such material, as well as the cost of the process to form the burner cap itself, is also cost prohibitive. In the consumer appliance industry, where literally hundreds of thousands of units are manufactured, such cost inefficiencies as exist with using conventional porcelain coated cast iron burner caps or forged brass burner caps unacceptably adds to the overall cost of manufacturing these ranges, thereby unacceptably affecting the profitability of the product. Because of the cost impact of this one area of the range, cost reduction of the burner cap and its method of manufacture has been the focus of a concerted effort throughout the industry.

As part of this effort to reduce the cost of material and manufacture of burner caps, the use of aluminum as the material from which to manufacture these burner caps has been investigated. Aluminum was initially chosen to be investigated because it is light weight, inexpensive, and easily molded into various shapes through conventional and relatively inexpensive die casting processes. However, it was found that when gas range burner caps were manufactured from aluminum using a conventional die casting process, the aluminum burner caps failed under the high cap temperature condition of a low flame setting on a conventional gas range. As explained above, this low flame setting of a conventional gas range results in the temperature of the gas burner cap reaching temperatures of between 900°F. to 1,000° F. While initially believed to be only approximately 95% of the eutectic temperature of the aluminum material used to construct the burner caps, such conditions resulted in the melting of the die cast aluminum burner caps.

In view of these initial failures, it became important to characterize the reasons for the failure, and to determine a method to overcome these failures if an actual cost reduction in the overall cost of manufacture of these burner caps would be realized.

SUMMARY OF THE INVENTION

In view of the above, it is therefore an object of the instant invention to overcome these and other known problems existing the manufacture and production of gas range burner caps. Specifically, it is an object of the instant invention to provide a new and improved, cost efficient method of manufacturing a gas burner cap. More particularly, it is an object of the instant invention to provide a method of manufacturing a gas burner cap from aluminum which is capable of withstanding a low flame setting on the gas range. Additionally, it is an object of the instant invention to provide a method of manufacturing an aluminum gas burner cap which is cost effective and which does not result in excessive scrap generated from the manufacturing process.

To achieve these and other objects of the invention, it is important first to analyze and characterize the causes of the failure of the die cast aluminum burner caps to gain an understanding into the material processes which occur near the eutectic temperature of the die cast aluminum resulting from the low flame setting condition. It is therefore an additional object of the invention to characterize the problem and the factors which give rise to a failure of the material before its eutectic temperature is reached.

In view of the foregoing and as a result of the above noted object and below described analysis of the causes of the problem, it is a feature of the instant invention to provide a method of manufacturing an aluminum gas burner cap resulting in a low level of porosity. More particularly, it is a feature of the instant invention to provide a method of manufacturing an aluminum burner cap which results in a level of porosity which substantially approaches zero. It is a further feature of the instant invention to provide a method of manufacture which minimizes the amount of machining required, and the amount of scrap generated during the manufacturing process.

In view of these and other objects and features of the instant invention, a preferred embodiment of the manufacturing method comprises the step of slowly forming an aluminum burner cap from non-porous aluminum. In a preferred embodiment, the step of slowly forming comprises the steps of preparing an aluminum slug from non-porous bar stock, placing the slug into a die, slowly advancing a ram to form the aluminum slug into the die in a cold flow impact extrusion process until the slug forms a compressed draw portion. A preferred embodiment of the instant invention further comprises the additional steps of machining the compressed draw material from the formed slug to form an outer peripheral edge of the aluminum burner cap.

In an alternate embodiment of the instant invention, the step of forming the burner cap comprises the step of machining non-porous aluminum bar stock.

Also in accordance with a preferred embodiment of the instant invention, a burner cap for a gas range having a burner base through which fuel gas is delivered comprises an aluminum body defining an essentially parallel upper and a lower surface, the aluminum body being configured to mate with the burner base of the gas range. The lower surface of the aluminum body of the burner cap cooperates with the burner base to form a manifold therebetween for the mixing of gas and air and for the distribution of the mixture to a plurality of openings located around the periphery. In a preferred embodiment of the instant invention, the aluminum body is non-porous.

A preferred embodiment of the instant invention also includes an aluminum burner cap for a gas range made by the process of the instant invention. Preferably, an aluminum burner cap of the instant invention has a porosity approaching zero.

These and other aims, objectives, and advantages of the invention, will become more apparent from the following detailed description while taken into conjunction with the accompanying drawings.

Figure 1:
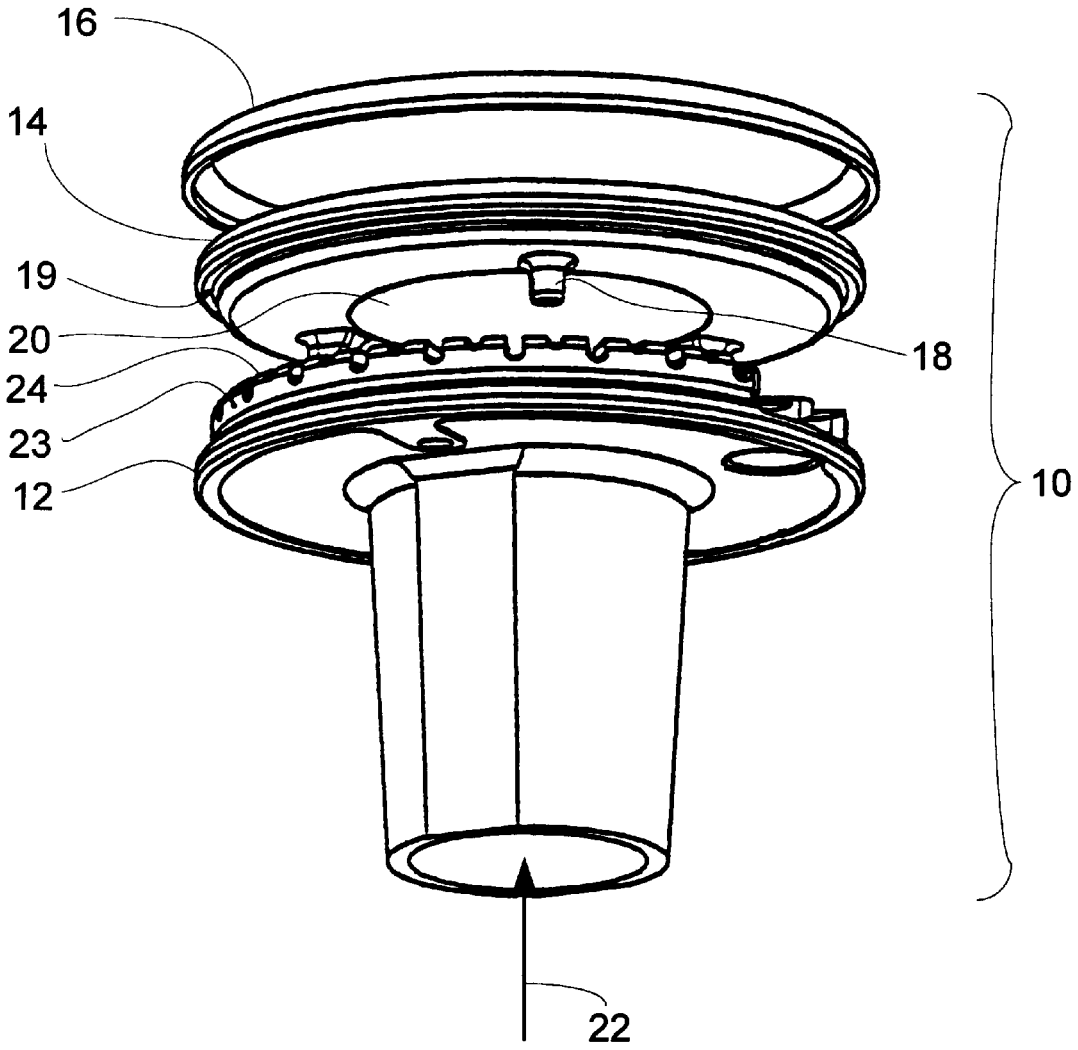
FIG. 1 illustrates an exploded isometric view of a surface burner configuration for a gas range.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, methods, and equivalents falling within the spirit and scope of the invention as defined by the appended claims.

DETAILED DESCRIPTION OF THE PREFERRED EMBODIMENT

As discussed above, the failure of the die cast aluminum burner caps at a temperature lower than the calculated eutectic temperature of the material used to construct these burner caps was somewhat of a surprise and a mystery when it was observed. As a result of these failures, an investigation was undertaken to characterize the causes of these failures. Through analysis and experimentation it was determined that the porosity of the aluminum which results from using a conventional die cast manufacturing process had significantly contributed to the cause of the failure of the aluminum burner caps.

Specifically, it was determined that as the die cast aluminum is heated near its eutectic temperature, its tensile strength decreases significantly. However, it was also determined that the forces generated by the heating and expanding of the trapped gases in the die cast aluminum increases significantly as the material is heated. During this heating process, a point is reached at which the conflicting relationships between the tensile strength of the aluminum and the generated forces of the heated, expanding trapped gas cross. At that point, the forces generated by the heated, expanding trapped gases overcomes the reduced tensile strength of the aluminum, resulting in failure of the gas burner caps prior to reaching the eutectic temperature of the aluminum.

Based upon this analysis and the new understanding of this unique problem, it was believed that if a process could be utilized which reduced the porosity which resulted in the completed gas burner cap, then aluminum could still be utilized in an effort to reduce the overall cost of manufacturing of a gas range. However, it was also realized that such a process would need to be economical so as to not detract from the cost benefits of using aluminum in the first place. To that end, various methods of manufacturing were developed for the burner cap and tested. However, testing results from these various methods still showed premature failure of the aluminum burner caps, even though the porosity of the resulting aluminum burner caps was reduced from that of conventional die casting.

As it became obvious that measurable levels of porosity were unacceptable for this application, a vacuum vertical die casting process was attempted because it is believed that this process results in the lowest porosity achievable through any type of die casting process. The aluminum burner caps which resulted from this vacuum vertical die casting process had a significantly reduced porosity as compared to conventional die casting as was expected. However, even with the extremely low levels of porosity resulting from using this vertical vacuum die casting process, the aluminum gas burner caps still failed under the low flame setting, high temperature condition.

Upon the failure of the aluminum burner caps manufactured by the very low porosity vacuum vertical die casting process, it was realized that the use of aluminum as the burner cap material would require a process resulting in a level of porosity approaching zero. Once this problem was characterized and understood, it was realized that such levels of porosity may be achieved by machining aluminum bar stock, although the cost of such a process is somewhat prohibitive, possibly outweighing any cost advantage achieved by using aluminum in the first place. The cost of tooling and the amount of material which needs to be machined away from the bar stock to properly form the burner cap makes this process less acceptable for application to a gas range burner cap, although such a process is an alternate embodiment of the instant invention.

In view of the cost of machining aluminum bar stock, a more economical aluminum squeeze die casting process was investigated. In this process, non-porous aluminum is heated until it becomes quite soft, somewhat like warm butter. Once this stage is reached, the heated aluminum is rapidly rammed into a die to form the burner cap. After the stroke of the machine, a high pressure force is used to squeeze the aluminum in the mold in an effort to remove any trapped gasses. While it was believed that this process would result in a non-porous aluminum burner cap capable of withstanding the low flame setting of a conventional gas range, it was actually determined through experimentation that these burner caps failed as well.

It then became apparent that a process would need to be developed using non-porous aluminum which would not introduce porosity into the material during the process itself. Based on the results of the squeeze die casting process, it was determined that a relatively slow process would be needed to prevent the introduction of porosity within the aluminum. One such process utilizing a slow pour permanent mold gravity cast process is disclosed in co-pending application Serial No. (not yet assigned), filed on Nov. 25, 1997, entitled ALUMINUM BURNER FOR GASEOUS FUEL AND METHOD OF MAKING SAME, by Kwiatek et al., the disclosure and teachings of which are hereby incorporated by reference.

Experience with such methods has led to the realization that to aid the prevention of porosity introduction, and to help keep the cost of the process down, the aluminum should not be heated to a point where porosity introduction would be aided similar to that required by the squeeze die cast process.

Figure 2:
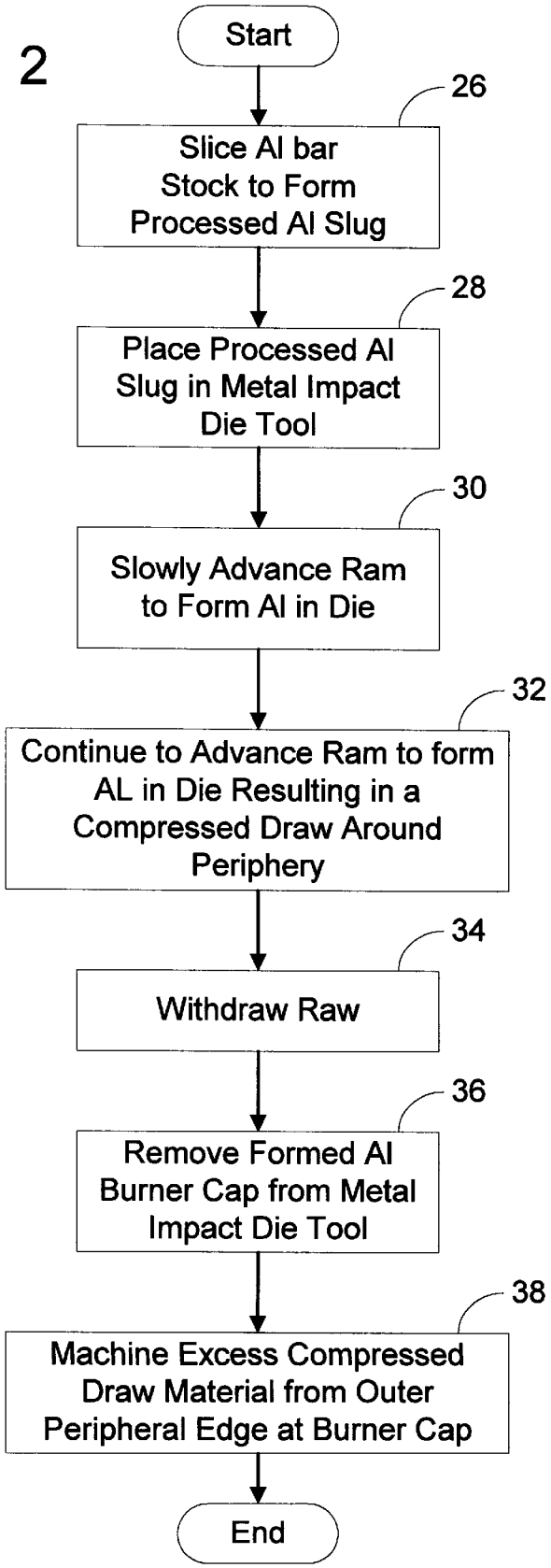
FIG. 2 illustrates a flow diagram of a method of manufacturing an aluminum burner cap for a gas range in accordance with an aspect of the instant invention.

Therefore, in a preferred embodiment of the instant invention, as illustrated in flow diagrammatic form in FIG. 2, the process of manufacturing an aluminum burner cap for a conventional gas range begins at step 26 by preparing an aluminum slug from an aluminum bar stock. Preferably, the aluminum slug is in the form of a hockey puck and is sliced from a somewhat soft pure aluminum alloy, such as, for example, Alloy 1100. Once the aluminum slug has been prepared, it is placed in a die configured to form the burner cap at step 28. A ram is then slowly advanced against the aluminum slug at step 30 to slowly force the aluminum under continuous movement into the die to form the burner cap. The ram is continued to advance to form the aluminum into the die, resulting in the formation of a compressed draw around the outer periphery of the burner cap at step 32.

Once the burner cap has been formed by this relatively slow metal impact process, the ram is withdrawn at step 34. Thereafter, the formed aluminum burner cap is removed from the die at step 36. The excess compressed draw is then machined away from the outer periphery of the burner cap at step 38 to form the upper outer edge of the burner cap to complete the process. An optional finishing step (not illustrated) may also be performed to apply a surface finish to the completed aluminum burner cap if so desired.

Figure 3:
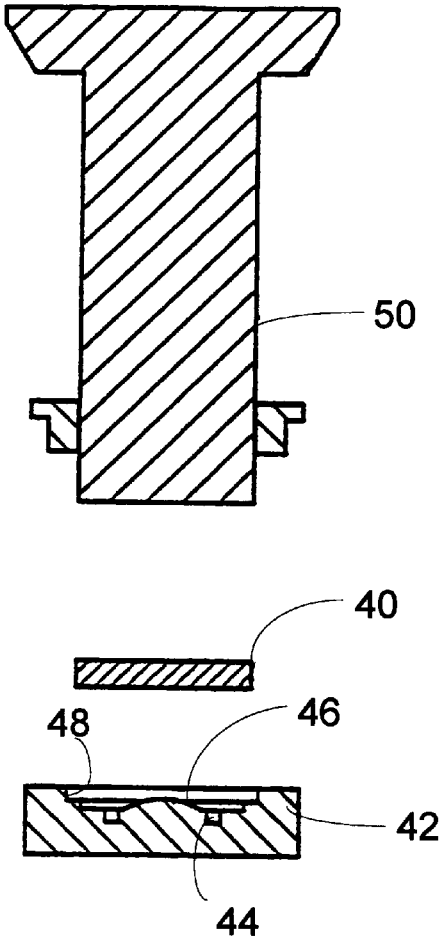
FIG. 3 cross sectionally illustrates a first intermediate step of the manufacturing process of FIG. 2 in accordance with an aspect of the instant invention.

This process may be better understood with reference to FIGS. 3–7 which crossectionally illustrate the intermediate process steps of a preferred embodiment of the instant invention. With reference first to FIG. 3, there is illustrated a prepared aluminum slug 40 which is positioned in a die 42 of a metal impact forming tool. The die 42 includes recessed regions 44 to form the spacer/locator legs 18 (see FIG. 1), as well as a convex portion 46 to form the concave portion 20 of the burner cap if required by the burner cap design. As will be described more fully below, the size of the die opening 48 is larger than the diameter of the prepared aluminum slug 40 and the ram 50.

Figure 4:
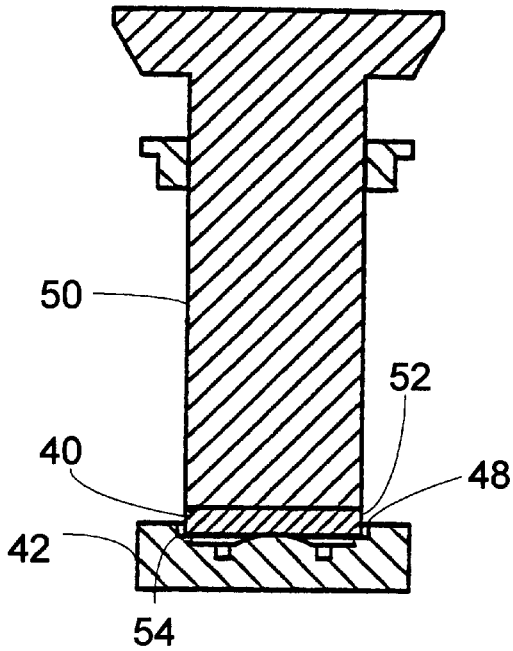
FIG. 4 cross sectionally illustrates a second intermediate step of the manufacturing process of FIG. 2 in accordance with an aspect of the instant invention.

This relationship is more easily observed with reference now to FIG. 4 which illustrates the engagement of the ram 50, the prepared aluminum slug 40 and the die 42. As the engagement 52 of the slug 40 and ram 50 illustrate, preferably the diameter of the prepared aluminum slug 40 and the ram 50 are approximately the same. Slight variations from this relationship are acceptable so long as the diameter of the ram 50 is less than the diameter of the die opening 48, and is greater than the diameter of the die inner forming surface 54.

Figure 5:
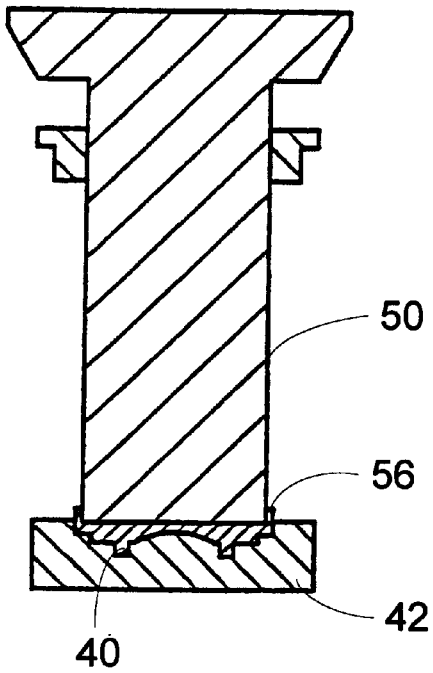
FIG. 5 cross sectionally illustrates a third intermediate step of the manufacturing process of FIG. 2 in accordance with an aspect of the instant invention.
Figure 6:
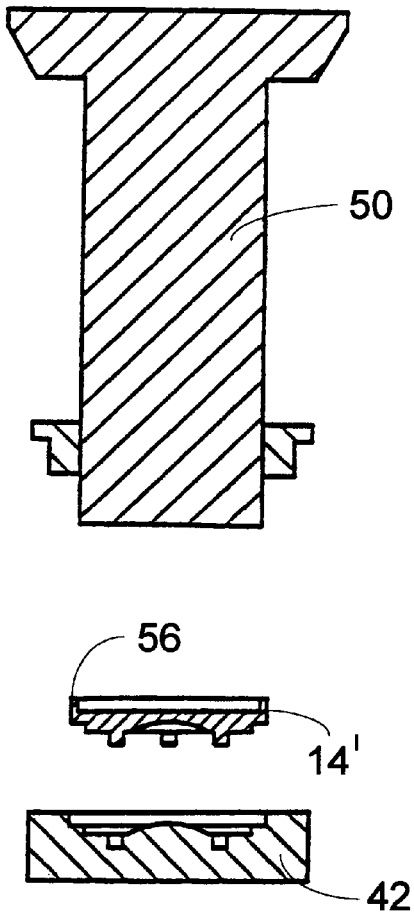
FIG. 6 cross sectionally illustrates a fourth intermediate step of the manufacturing process of FIG. 2 in accordance with an aspect of the instant invention.
Figure 7:
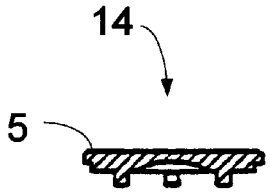
FIG. 7 cross sectionally illustrate a completed aluminum burner cap produced by the manufacturing process of FIG. 2 in accordance with an aspect of the instant invention.

As the ram 50 is advanced, as illustrated in FIG. 5, the aluminum slug 40 is forced slowly into the die 42, deforming thereby and conforming thereto. As the aluminum is forced into the die 42, the excess aluminum which does not fill the recessed regions of the die is allowed to form a compressed draw 56 around the outer periphery of the aluminum slug 40. As the ram 50 is withdrawn, the partially formed aluminum burner cap 14" is removed from the die 42 as illustrated in FIG. 6. Once removed, the excess compressed draw material 56 is machined off to form the outer peripheral edge 58 of the finished aluminum burner cap 14 as illustrated in FIG. 7. These aluminum burner caps 14 made by this cold flow metal impact extrusion process are non-porous, and successfully withstand the low flame setting, high burner cap temperature condition of a conventional gas range.

As it was learned that rapid metal forming processes introduce porosity into the formed aluminum burner cap, resulting in failure of these burner caps under the low flame condition, other process may be applied to achieve the same results, so long as they utilize a slow formation step to avoid porosity, and are therefore within the scope of the invention.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. The details of the structure and architecture may be varied substantially without departing from the spirit of the invention, and the exclusive use of all modifications which come within the scope of the appended claims is reserved.

What is claimed is:

1. A method of manufacturing a burner cap for use on a conventional gas range, comprising the steps of:

preparing a non-porous aluminum slug;

placing the aluminum slug in a die;

advancing a ram against the aluminum slug to force the aluminum into the die to form an intermediate burner cap;

halting the advancement of the ram upon formation of a compressed draw on the intermediate burner cap;

removing the intermediate burner cap from the die; and removing the compressed draw portion from the intermediate burner cap to form the outer peripheral edge of the burner cap.

2. The method of claim 1, wherein the step of preparing an aluminum slug comprises the step of allowing the aluminum slug to remain at ambient temperature.

3. The method of claim 1, further comprising the step of applying a surface finish on the burner cap.

4. The method of claim 1, wherein the step of advancing the ram is performed slowly such that the non-porous nature of the aluminum slug is maintained.

5. The method of claim 1, wherein the step of removing the compressed draw portion from the intermediate burner cap comprises the step of machining the compresses draw portion from the intermediate burner cap.

6. A method of manufacturing an aluminum burner cap for use on a gas range, comprising the steps of:

preparing a non-porous aluminum slug;

placing the aluminum slug in a die;

slowly advancing a ram against the aluminum slug to force the aluminum slug into the die to form a burner cap; and removing the burner cap from the die.

7. The method of claim 6, wherein the step of slowly advancing a ram is continued until a compressed draw is formed on the aluminum slug, the method further comprising the step of removing the compressed draw portion from the burner cap to form the outer peripheral edge of the burner cap.

8. The method of claim 6, wherein the step of preparing an aluminum slug comprises the step of allowing the aluminum slug to remain at ambient temperature.

9. The method of claim 6, wherein the step of slowly advancing the ram is performed at a rate such that the non-porous nature of the aluminum slug is maintained.

10. A method of manufacturing a burner cap for a gas range, comprising the steps of:

providing an amount of non-porous aluminum;

forming the aluminum into the shape of a burner cap such that the non-porous nature of the aluminum is maintained;

wherein the step of providing an amount of non-porous aluminum comprises the step of preparing a slug of non-porous aluminum at ambient temperature; and wherein the step of forming the aluminum into the shape of a burner cap comprises the step of machining the slug to form the burner cap.

* * * * *